US011613842B2

(12) United States Patent
Bringewatt et al.

(10) Patent No.: US 11,613,842 B2
(45) Date of Patent: Mar. 28, 2023

(54) METHOD FOR DETERMINING THE SHORTER AND/OR LONGER EDGE OF ITEMS OF LAUNDRY AND FOR FEEDING ITEMS OF LAUNDRY TO A LAUNDRY TREATMENT APPARATUS

(71) Applicant: Herbert Kannegiesser GmbH, Vlotho (DE)

(72) Inventors: Wilhelm Bringewatt, Porta Westfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 50 days.

(21) Appl. No.: 16/734,668

(22) Filed: Jan. 6, 2020

(65) Prior Publication Data

US 2020/0224359 A1 Jul. 16, 2020

(30) Foreign Application Priority Data

Jan. 11, 2019 (DE) ..... 102019000127.3

(51) Int. Cl.
*D06F 95/00* (2006.01)
*B65H 7/14* (2006.01)
*D06F 93/00* (2006.01)

(52) U.S. Cl.
CPC ..... *D06F 95/00* (2013.01); *B65H 7/14* (2013.01); *D06F 93/00* (2013.01)

(58) Field of Classification Search
CPC ..... D06F 95/00; D06F 93/00; D06F 67/04; B65H 7/14
See application file for complete search history.

(56) References Cited

U.S. PATENT DOCUMENTS 9,988,220 B2 * 6/2018 Sielermann ..... D06F 67/04

FOREIGN PATENT DOCUMENTS

DE 3912977 A1 10/1990
DE 102014017477 A1 6/2016
(Continued)

OTHER PUBLICATIONS https://SOCRATIC.ORG/questions; "How is the Pythagorean theorem related to the distance formula?" Jan. 2015 (Year: 2015).*
(Continued)

*Primary Examiner* — Lynn E Schwenning
(74) *Attorney, Agent, or Firm* — Laurence P. Colton; Smith Tempel Blaha LLC

(57) ABSTRACT

A method that facilitates the automatic identification of the long edge or the short edge of the item of laundry by determining the lengths or the angles of the edge areas of the item of laundry extending from a lower corner of the item of laundry. It may be derived from the determined angles or lengths of the edge areas whether the respective edge area belongs to the long edge or to the short edge of the item of laundry. With this information, a targeted transverse or longitudinal feed of rectangular items of laundry may be carried out to a downstream inserting machine. The fully automated feeding of items of laundry to, for example, an inserting machine is carried out in a targeted way with either the long edge of the item of laundry extending transversely to the feed direction or the short edge extending transversely to the feed direction.

9 Claims, 5 Drawing Sheets

(56) References Cited

FOREIGN PATENT DOCUMENTS

| | | |
|---|---|---|
| EP | 3147405 A1 | 3/2017 |
| EP | 3290578 A1 | 3/2018 |

OTHER PUBLICATIONS

CPM Educational Program; "Properties of Quadrilaterals"; 2007 (Year: 2007).*
Deutsches Patent-Und Markenam (German Patent an Trademark Office), Recherchenbericht (search in a related application), dated Jul. 18, 2019.
European Patent Office, Europaischer Recherchenbericht (searchin a related application), dated May 11, 2020.

* cited by examiner

METHOD FOR DETERMINING THE SHORTER AND/OR LONGER EDGE OF ITEMS OF LAUNDRY AND FOR FEEDING ITEMS OF LAUNDRY TO A LAUNDRY TREATMENT APPARATUS

CROSS REFERENCE TO RELATED APPLICATIONS

This patent application claims priority on and the benefit of German Patent Application No. 10 2019 000 127.3 having a filing date of 11 Jan. 2019.

BACKGROUND OF THE INVENTION

Technical Field

The invention relates to a method for determining the shorter and/or longer edge of items of laundry and a method for feeding items of laundry to a laundry treatment apparatus.

Prior Art

Items of laundry, namely in particular, flat items of laundry, like tablecloths, bedspreads, sheets, pillow cases or the like, are fed to laundry treatment machines with a front edge extending transversely to the feed direction. Laundry treatment machines may be inserting machines for feeding spread out items of laundry to mangles, folding machines, inspection devices, sorting devices, or the like.

Rectangular items of laundry with edges of unequal length are fed in a targeted way to the respective laundry treatment apparatus using one such front edge, where it is a longer or a shorter edge. It would be preferred, for example, to feed rectangular items of laundry to a mangle in a targeted way with the longer or shorter edge oriented transversely as the front edge, so that the working width of the mangle is exploited to the greatest extent in the case of both a one-track and also a multi-track mangle configuration. In the case of folding machines, the feeding of items of laundry with longer or shorter transverse front edges is necessary in order to be able to fold the items of laundry according to the folding template that is provided.

Up until now, the approach has been that, when manually hanging up adjacent corners of the front edge of items of laundry in the loading or spreading clips of inserting machines, the desired longer or shorter edge has been sought and the respective item of laundry is hung up in the clips using associated adjacent clips, thus with the longer or shorter edge thus extending transverse to the feed direction. This does not allow for a fully automated feeding.

Arising from the above-mentioned summary, the underlying object of the invention is to create an automated method for determining the longer and/or the shorter edge of items of laundry and/or to create a method for automated feeding of items of laundry to a laundry treatment apparatus.

A method for solving the specified problem is a method for determining a longer edge and/or a shorter edge of items of laundry, wherein which edge area belongs to the longer edge and/or to the shorter edge of the item of laundry is automatically derived from the different directions or lengths of the edge area extending from a corner of the item of laundry hanging freely downward. Accordingly, it is provided to determine different directions or lengths of the edge area extending from a free corner of the item of laundry hanging downward, and to derive therefrom which edge area belongs to the longer and/or shorter edge of the item of laundry. These measures may be carried out automatically, so that by using the method, the shorter and/or longer edges of items of laundry may be automatically determined.

This method preferably provides the angles or the lengths of the edge areas extending from a lower free second corner, preferably the second corner diagonally opposite the first corner, in the case that an item of laundry is hanging downward from a first corner, to derive the longer and/or shorter edge of the item of laundry. Edge areas, whose angle or length permits reliable conclusions about the longer or shorter edge of the item of laundry, are particularly reliably defined by the second lower corner hanging below an upper first corner, freely held, for example, by a clip.

It is particularly advantageous to use those areas of the edges of the item of laundry extending from the second (lower) corner as the edge areas to determine the longer and/or shorter edge of the item of laundry, said edges extending in a straight line or at least ideally in a straight line. The lengths and/or angles of such edge areas may be accurately, in particular automatically, determined.

According to one advantageous embodiment of the method, it is provided that the longer and/or shorter edge of the item of laundry is derived from a comparison of the angles or lengths of the two edge areas extending from the second corner. This is based on the knowledge that, for rectangular items of laundry, the angle and/or the length of the edge areas extending from the lower second corner are different, and certain conclusions about the length of those edges of the item of laundry may be made, based on these differences, as to where the respective edge area belongs. Thus, long and short edges of rectangular items of laundry may be reliably distinguished, and it may also be determined where the longer or shorter edge of the item of laundry, in particular of the item of laundry hanging down from a first freely held corner, is located and/or to which edge area this is to be assigned.

A preferred possible refinement of the method provides using those angles for deriving the shorter and/or longer edge of the item of laundry, which angles lie between the respective edge area and an imaginary horizontal and vertical reference line through a corner point of the second corner of the item of laundry. At least one edge, the longer and/or shorter edge of the respective item of laundry may thus be easily and reliably determined through two angle measurements and a comparison of the measured angles.

The angles of the edge areas extending from the second corner are preferably determined with respect to an imaginary horizontal reference line through a corner point of the second corner, and the longer and/or shorter edge of the item of laundry is derived from this, in that the longer edge is considered as belonging to that edge area, which extends at a larger angle to the imaginary horizontal reference line, and/or the shorter edge belongs to that edge area that extends at a smaller angle to the horizontal reference line. Such a derivation of the long and/or short edge of the item of laundry carried out from the measured angles of the edge areas to the imaginary horizontal reference line is also easy to carry out automatically and leads to reliable results, even for items of laundry whose long and short edges do not strongly deviate from one another and for which the edge areas do not extend in very straight lines.

Another advantageous embodiment of the invention provides that the angles of the edge areas extending from the second corner are determined with respect to an imaginary vertical reference line through a corner point of the second corner, and the smaller and/or shorter edge of the item of laundry is derived from this, in that the longer edge is assumed to belong to that edge area which extends at a smaller angle to the imaginary vertical reference line and/or the shorter edge belongs to the edge area that extends at a larger angle to the vertical reference line. These angle measurements may also be carried out with simple means, primarily also automatically, and the respectively sought longer edge or shorter edge may be derived with great reliability from the measured angles.

Another possible embodiment of the method provides for deriving from the longer of the edge areas extending from the second corner, that this edge area belongs to the longer edge and the shorter edge belongs to the shorter of the edge areas of the item of laundry extending from the second corner. In this method, the length of the edge areas is measured and compared. This length measurement may be carried out easily and with great reliability, primarily automatically, namely even if the edge areas do not extend exactly in straight lines.

One advantageous possible embodiment of the method provides that at least that part of the item of laundry, in which the second corner is located with at least parts of the two edge areas extending from this corner, is recorded by at least one image-providing device, preferably by at least one camera. The, preferably two-dimensional, image of the lower part of the item of laundry obtained from the camera with the second corner and at least parts of the edge areas extending therefrom is formed by a preferably electronic image analysis, in particular in such a way that the angles between the respective edge area and the horizontal or vertical reference line, or the lengths of the edge areas are determined and/or compared. From this, the image analysis may automatically carry out an assignment of the long and/or short edge of the respective item of laundry to the respective edge area based on the measured angles or lengths of the edge areas extending from the second corner.

Additional methods for solving the problem specified at the outset are a method for the automatic feeding of items of laundry to a laundry treatment apparatus, wherein the items of laundry are supplied to the laundry treatment apparatus in a targeted way, with a longer edge or shorter edge extending transversely to the feed direction, wherein the longer edge or shorter edge of the respective item of laundry is automatically determined before the feeding of the item of laundry to the laundry treatment apparatus, and a method for automatic feeding of items of laundry to a laundry treatment apparatus, wherein the items of laundry are supplied to the laundry treatment apparatus in a targeted way, with a longer edge or shorter edge extending transversely to the feed direction, wherein the longer edge or shorter edge of the respective item of laundry is automatically determined at the beginning of the feeding of the item of laundry to the laundry treatment apparatus.

Accordingly, it is provided for feeding items of laundry to a laundry treatment apparatus, preferably to an inserting machine, a mangle, a folding machine or the like, that preferably prior to this, the longer and/or shorter edge of the respective item of laundry is automatically determined according to the method disclosed and claimed herein. In particular, it is then, based on the automatic determination of the long and/or short edge of the item of laundry, in particular subsequent thereto, likewise automatically possible, to feed the respective item of laundry to a laundry treatment apparatus. For this purpose, the respective item of laundry may be automatically fed to the inserting machine and/or mangle, folding machine, or other laundry treatment apparatus in the provided orientation, namely either with a longer or shorter edge of the item of laundry extending transverse to the feed direction as the leading front edge. By this means, the through-put of the items of laundry through a mangle may be increased or the respective item of laundry may be folded according to a provided folding pattern depending on the transverse or longitudinally oriented feeding of the respective item of laundry to the folding machine.

BRIEF DESCRIPTION OF THE DRAWINGS

Preferred embodiments of the method according to the invention are subsequently explained in greater detail on the basis of the drawing. As shown in.

DETAILED DESCRIPTION OF PREFERRED EMBODIMENTS

Figure 1:
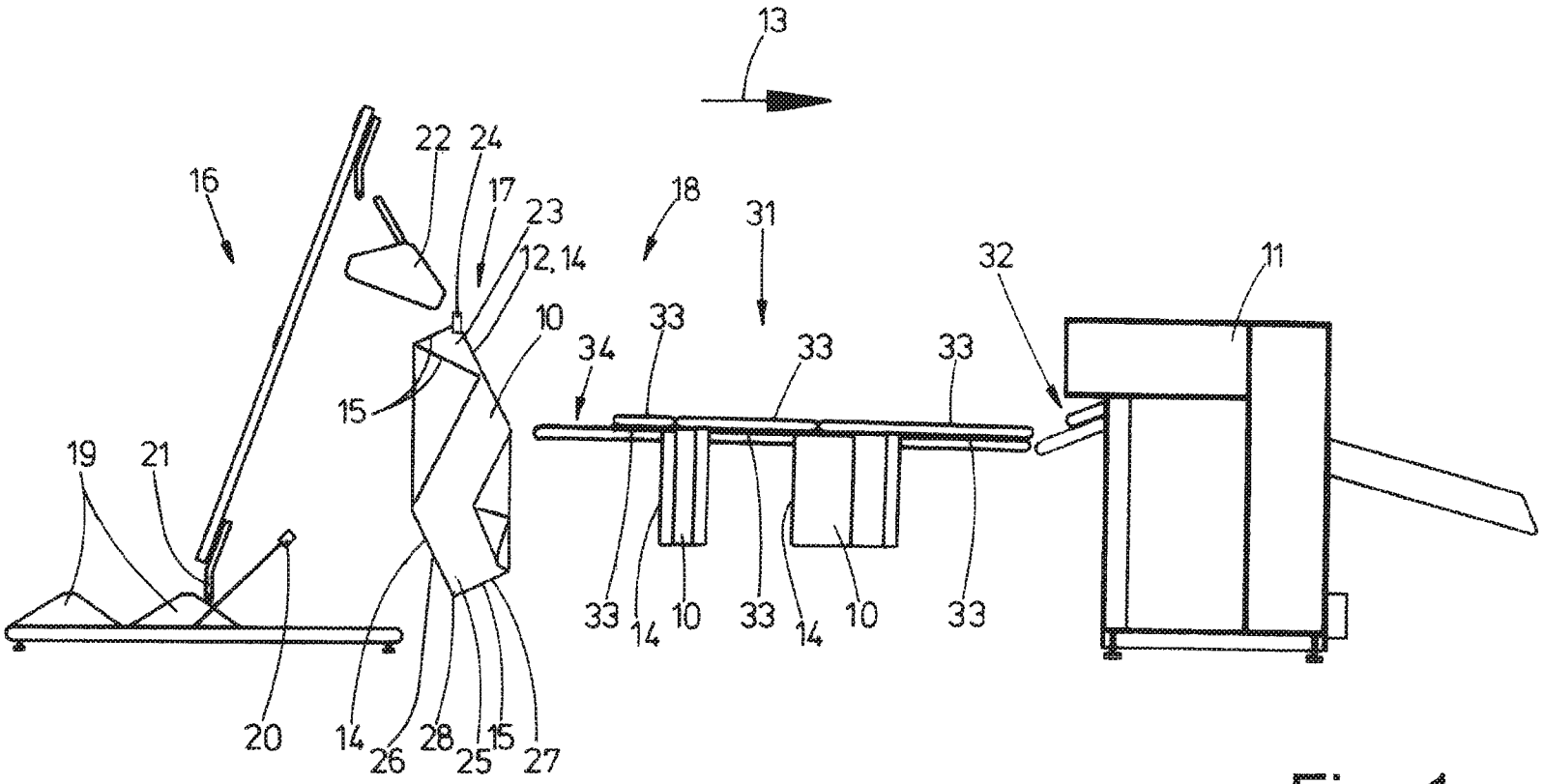
FIG. 1 is a schematic side view of a device for determining the longer or shorter edge of the item of laundry and for feeding this item of laundry to an inserting machine.

The device shown in FIG. 1 functions for automatic feeding and/or providing of items of laundry 10 into a so-called inserting machine 11. Inserting machine 11 has a spreading device with two spreading clips, which may be moved toward and away from one another, and which hold adjacent corners of a front edge 12 of item of laundry 10 representing a leading edge, and stretch out said front edge 12. Entire item of laundry 10 is thereby spread out by inserting machine 11 in order to be subsequently fed by inserting machine 11 to a laundry treatment apparatus downstream of the same, preferably a mangle.

Front edge 12 of item of laundry 10 is an edge extending transversely to feed direction 13 of item of laundry 10 to the mangle or to another laundry treatment apparatus, which edge may be both a long edge 14 and also a short edge 15 of the item of laundry—depending on whether relevant item of laundry 10 is to be fed longitudinally or transversely to feed direction 13 of inserting machine 11 and from there to the subsequent laundry treatment apparatus.

The invention is not limited to the device shown in the figures. Instead, the invention is suited for any other devices which function to feed items of laundry automatically to a mangle or another laundry treatment apparatus, for example a folding machine, or any apparatus which automatically sorts items of laundry. The invention is preferably provided for automated feeding processes in the laundry area.

The invention is basically suited for items of laundry 10 of all types, preferably so-called flat items of laundry. These are primarily tablecloths, bed sheets, pillowcases, bedspreads or the like.

Furthermore, the invention concerns automatically determining a long edge 14 and/or a short edge 15 of rectangular items of laundry 10. This determination of long edge 14 and/or of short edge 15 is preferably carried out before the automated feeding of the relevant item of laundry 10, having long edges 14 and short edges 15 with long edge 14 or short edge 15 extending in a targeted way transverse to feed direction 13, to the downstream laundry treatment apparatus, in particular the automated transfer of item of laundry 10 to inserting machine 11.

The device of FIG. 1 has, upstream of inserting machine 11 when viewed in feed direction 13, an automated separator 16, a subsequent edge detection device 17, and a spreading out device 18 following edge detection device 17, when viewed in feed direction 13.

Separator 16 functions for targeted, automated singling out of preferably one single item of laundry 10 from a pile of laundry 19. This is carried out by means of at least one camera 20 or other image-providing device in the vicinity of pile of laundry 19. An image analysis device controls a gripper 21 of separator 16, movable up and down along an ascending section, by means of the at least one image of camera 20. Gripper 21 transfers the, preferably individual, item of laundry 10, gripped by it, to a subsequent preparation device 22 of separator 16.

Preparation device 22 optionally carries out a separation of multiple items of laundry 10 gripped by gripper 21 at the same time and holds the separated (single) item of laundry 10 ready at an upper first corner 23 of edge detection device 17. An item of laundry 10, hanging down from one upper, first corner 23, is symbolically depicted in the figures. First corner 23 is thereby held by holding means 24. Said holding means 24 may be preparation device 22 or also a separate clip assigned thereto. Item of laundry 10 thereby hangs from holding means 24 and also under the same from upper first corner 23 while forming a free, lower second corner 25. Said second corner 25 may—as in the embodiment shown—lie diagonally opposite first corner 23.

Edge areas 26, 27 of a long edge 14 and a short edge 15 of item of laundry 10 extend from free, lower second corner 25 of item of laundry 10 hanging down from below first corner 23 held by holding means 24. Said edge areas 26 and 27 meet at a corner point 28 of second corner 25 of item of laundry 10. In the case of item of laundry 10, hanging freely down from first corner 23, edge areas 26, 27, namely lower sections of long edge 14 and short edge 15 meeting at second corner 25, have a straight line course or at least an ideally and/or approximately straight line course.

Figure 2:
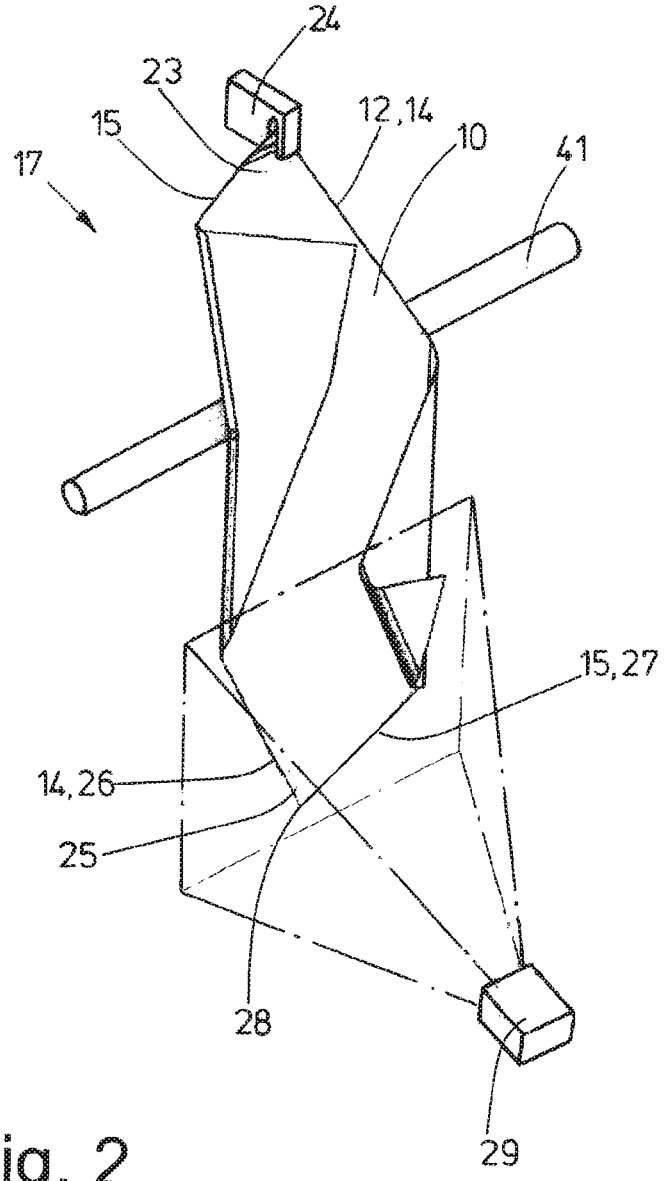
FIG. 2 is a schematic perspective depiction of the image data acquisition of the lower part of an item of laundry.

Next to a lower part of item of laundry 10, preferably next to free, lower second corner 25, is an image-producing device, which is a stationarily-arranged camera 29 in the embodiment shown. Camera 29, which in the simplest case is a two-dimensional black/white camera, is designed to detect the surface of a lower part of item of laundry 10 (FIG. 2). Camera 29 detects at least one such lower part, primarily a lower surface, of item of laundry 10, across which edge areas 26, 27 of item of laundry 10, extending from second corner 25, in particular from its corner point 28, generally extend.

The two-dimensional image recorded by camera 29, in particular the image data, of the lower partial surface of item of laundry 10 is transmitted to an image analysis device, not shown in the figures, which determines or derives information and/or measured values from the recorded image, said information and/or measured values will be discussed below in greater detail in the description of the method according to the invention.

FIG. 2 shows a preferably horizontally-extending stabilizing bar 41. Item of laundry 10 may be brought into contact with a central area thereof with stabilizing bar 41. This happens before camera 29 records the lower surface area of item of laundry 10. By bringing the central area of item of laundry 10 into contact with stabilizing bar 41, an upper part of item of laundry 10 is folded somewhat with respect to its lower part including the surface area being recorded by camera 29. By this means, that part of item of laundry 10, which is located underneath stabilizing bar 41, is stabilized and brought into a defined distance from camera 29. This all leads to the fact that camera 29 may generate an image of the lower partial surface of item of laundry 10, which may be reliably analyzed with respect to the angles and/or lengths of edge areas 26 and 27. This also contributes to obtaining exact measured values. The central area of item of laundry 10 may be brought into contact with stabilizing bar 41 by a lateral approaching of item of laundry 10 to stationary stabilizing bar 41; however also alternatively or additionally by an approach of stabilizing bar 41, which is not stationary in this case, to the central area of item of laundry 10.

Figure 6:
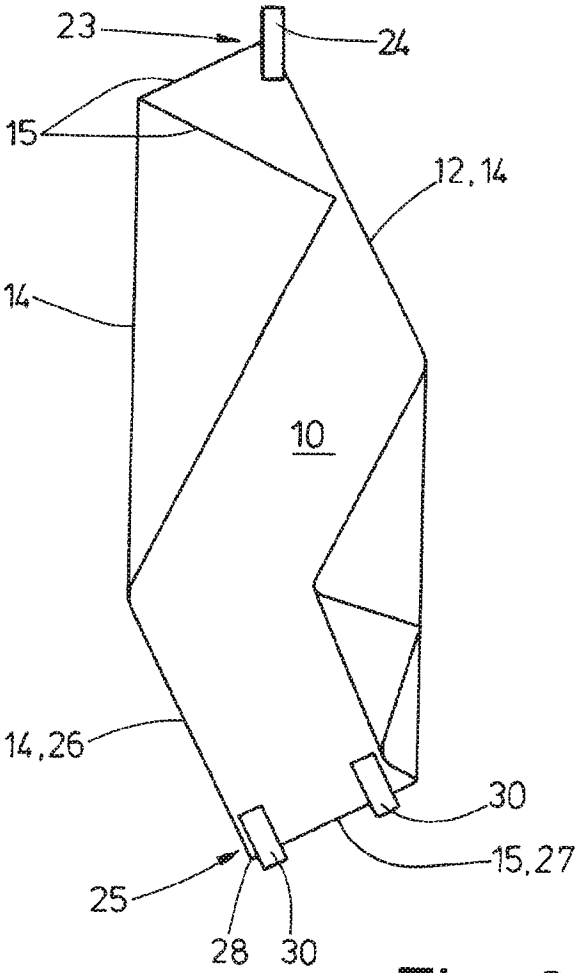
FIG. 6 illustrates the gripping of a lower part of the item of laundry after the measuring.
Figure 7:
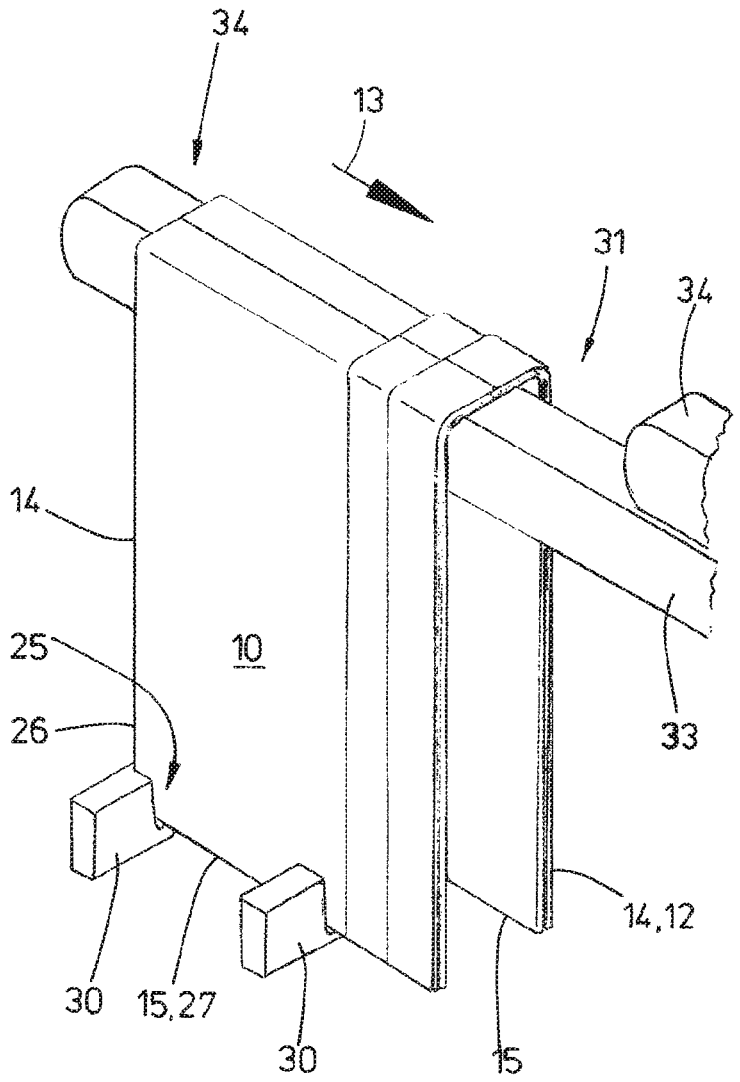
FIG. 7 is a perspective view of the item of laundry deposited with the longer edge over a first conveyor of a cascade conveyor.

The device additionally has two clips 30 (FIGS. 6 and 7). Preferably identical clips 30 have a defined distance apart from one another. This distance may be constant; however, it may also be changeable. Clips 30 may be separate clips; however, they may also be clips 30 connected into a double clip. Clips 30 may be spatially moved together. For this purpose, they are either displaceable along corresponding rails or linear drives or arranged on the free end of an arm of a handling device, for example, of an industrial robot. The mutual displacement of two clips 30, spaced apart in parallel, is preferably controlled by means of the data recorded by camera 29, for example, image data.

By means of the image data recorded by camera 29 of the lower area or of the lower partial surface of item of laundry 10, clips 30 may be moved jointly to an edge area 26, 27 of item of laundry 10 in such a way that one clip 30 collect relevant edge area 26 or 27 at lower second corner 25 or at least close to corner 25 and second clip 30, spaced apart therefrom, grips relevant edge area 26, 27 spaced apart from second corner 25. Thus, a large part of relevant edge area 26, 27, extending from second corner 25, is able to be firmly clamped, ideally extending in a straight line, between clips 30.

If item of laundry 10 is now lifted up by spaced apart clips 30 using an edge area 26, 27 held by the same, and first corner 23 is released by holding means 24, a long edge 14 or a short edge 15 of item of laundry 10 forms under outer clip 30 holding second corner 25 at corner point 28 or close to corner point 28. For the subsequent description, it will be assumed that two spaced apart clips 30 hold edge area 27, which belongs to short edge 15 of item of laundry 10, and correspondingly forms a long edge 14, hanging perpendicularly downward, to which edge area 26 belongs, under clip 30, in particular under outer clip 30. This long edge 14 or the long edge of item of laundry 10 extending parallel thereto and opposite therefrom then becomes front edge 12 or the leading edge of item of laundry 10 extending transversely to feed direction 13. The subsequent feeding of item of laundry 10 to inserting machine 11 or the inserting into the mangle or folding machine is then carried out through preceding front edge 12, thus the long edge parallel to long edge 14.

Spaced-apart clips 30 may belong to spreading out device 18. This additionally has a cascade conveyor 31. The conveyor direction of cascade conveyor 31 corresponds to feed direction 13. Item of laundry 10 is transported in the embodiment shown from cascade conveyor 31 to inserting machine 11 and automatically transferred to the same, for example, at a loading conveyor 32. Cascade conveyor 31 comprises a plurality of successive pairs of belt conveyors 33 arranged above one another. Items of laundry 10 may be transported in feed direction 13 along cascade conveyor 31 to inserting machine 11 between belt conveyors 33 arranged above one another in a sandwich-like way, namely the runs of the same are aligned with respect to one another. The initial pair of belt conveyors 33 of cascade conveyor 31 arranged over one another is designed differently. Lower belt conveyor 33 is longer than upper belt conveyor 33. By this means, a depositing area 34, exposed and released by upper belt conveyor 33 of this belt conveyor pair, is created at the beginning of cascade conveyor 31 on the upper run of lower belt conveyor 33 which projects farther in edge detection device 17.

The individual pairs of belt conveyors 33 arranged above one another of cascade conveyor 31 are driven in feed direction 13 with increasing rotational speed. This leads to a spreading out of the respective item of laundry in and/or counter to feed direction 13. The speed differences of the individual pairs of belt conveyors 33 arranged over one another and the number of pairs of belt conveyors 33 arranged over one another is selected for cascade conveyor 31 so that at the end of cascade conveyor 31, items of laundry 10 of different types and shapes are sufficiently spread out so that respective item of laundry 10 may be automatically transferred to loading conveyor 32 of inserting machine 11 with front edge 12 extending transverse to the feed direction.

The methods according to the invention will be subsequently explained in greater detail with reference to the device from the figures, in particular FIG. 1. It is hereby assumed that a preceding, longer edge of item of laundry 10, extending parallel to long edge 14, is to be front edge 12 or the leading edge of item of laundry 10, extending transversely to feed direction 13 during feeding of the same to inserting machine 11.

In the area of edge detection device 17 at the beginning of spreading out device 18, at least one lower part of item of laundry 10 hanging down from holding means 24 is recorded by camera 29 or another image-providing device. Camera 29 thereby records at least the lower partial area of item of laundry 10 from the side, thus the profile or the surface of this lower partial area. Using the image data recorded by camera 29, the angles and/or lengths of edge areas 26, 27 of a long edge 14 and an adjoining short edge 15 of item of laundry 10 extending from second corner 25 hanging downward are automatically determined in an electronic way and/or determined by calculation from an image analysis. By comparing the angular differences and/or length differences of edge areas 26, 27, which edge area 26 or 27 belongs to a long edge 14 or to a short edge 15 may be derived from the image data obtained from camera 29.

After the automatic determination of a long edge 14 and a short edge 15 of item of laundry 10, that edge area 26, 27, which does not belong to an edge 14 or 15, forming front edge 12 extending transverse to feed direction 13, in the present embodiment thus edge area 27 of short edge 15, is gripped by two clips 30 spaced apart from one another. This takes place according to the depiction in FIG. 6 in such a way that one clip 30 grips edge area 27 close to corner point 28 of second corner 25 and second clip 30 encompass edge area 27 at a significant distance from first clip 30, preferably at the end opposite second corner 25 of edge area 27 extending in a straight line or at least ideally in a straight line, which belongs to shorter edge 15. By simultaneous movement of two clips 30, second corner 25 is now lifted up by clips 30 and first corner 23 is released by holding means 24. Item of laundry 10 is thus virtually turned. At the same time, or before or after the turning, two clips 30 are reoriented in such a way that edge area 27 held between the same extends at least approximately horizontally. Thus, long edge 14 of item of laundry 10, extending perpendicular from clip 30 located close to corner point 28, is formed. Ideally, edge 14 hangs downward from clip 30 from corner point 28 of second corner 25 in a straight perpendicular line, or at least essentially perpendicularly. Depending on the reorientation of clips 30 representing the clip pairs, long edge 14, extending from second corner 25, may face inserting machine 11 or—as in the present embodiment—be aligned with separator 16.

After the determination of long edge 14 of item of laundry 10 and the forming of a straight, perpendicular course of said long edge 14 below clips 30 holding item of laundry 10 in parallel, parallel clips 30 are moved jointly in height and transversely to depositing area 34 of cascade conveyor 31, and item of laundry 10 is deposited in an approximately U-shape on depositing area 34 at the beginning of cascade conveyor 31, namely so that item of laundry 10 hangs down with approximately equally long sections from both sides of depositing area 34, wherein first corner 23 and second corner 25 are essentially opposite (FIG. 7). In the subsequent U-shaped hanging of item of laundry 10 over depositing area 34 of cascade conveyor 31, the long parallel edge of item of laundry 10, opposite long edge 14 hanging down under outer clip 30 in a straight line, moves quickly in feed direction 13. This leading, long edge of item of laundry 10 thus becomes front edge 12 of item of laundry 10 extending transverse to feed direction 13, which, after the transfer of item of laundry 10, spread out by spreading device 18, is itself spread out at inserting machine 11 by the spreading clips, With this long edge in front forming front edge 12 or the leading edge, item of laundry 10, spread out by inserting machine 11, is then fed to the subsequent laundry treatment apparatus, preferably a mangle.

Figure 4:
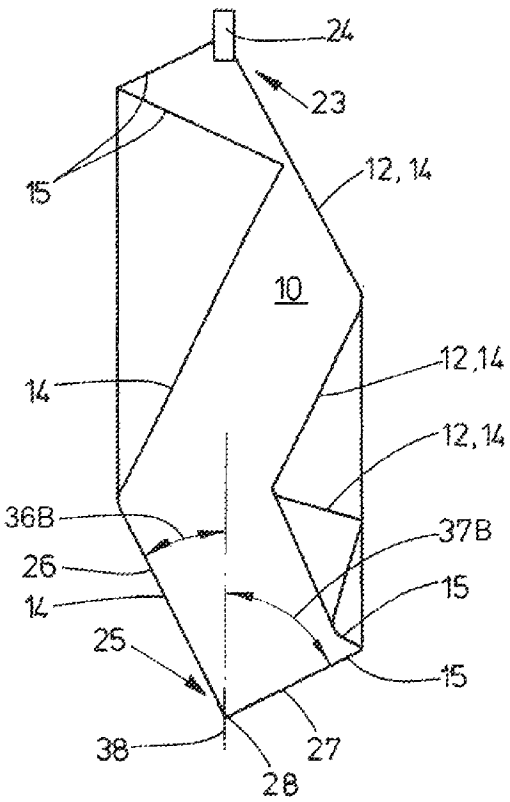
FIG. 4 is a second embodiment for measuring the lower part of the item of laundry in a depiction analogous to FIG. 3.
Figure 3:
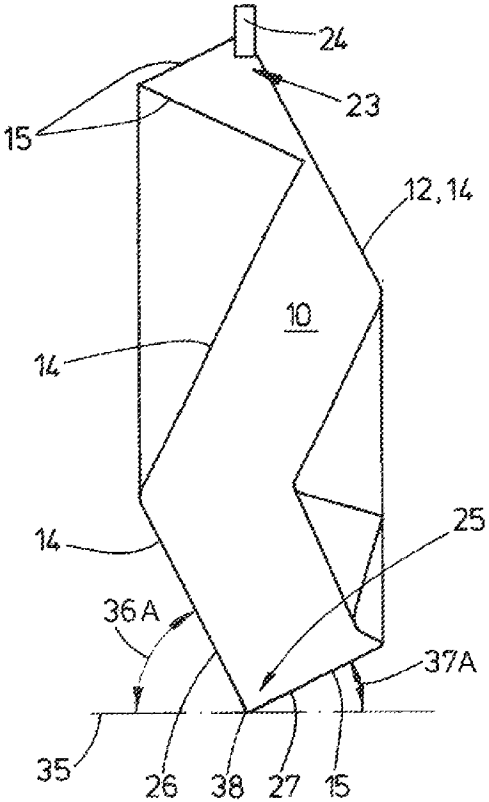
FIG. 3 is a first embodiment for measuring a lower part of the item of laundry.
Figure 5:
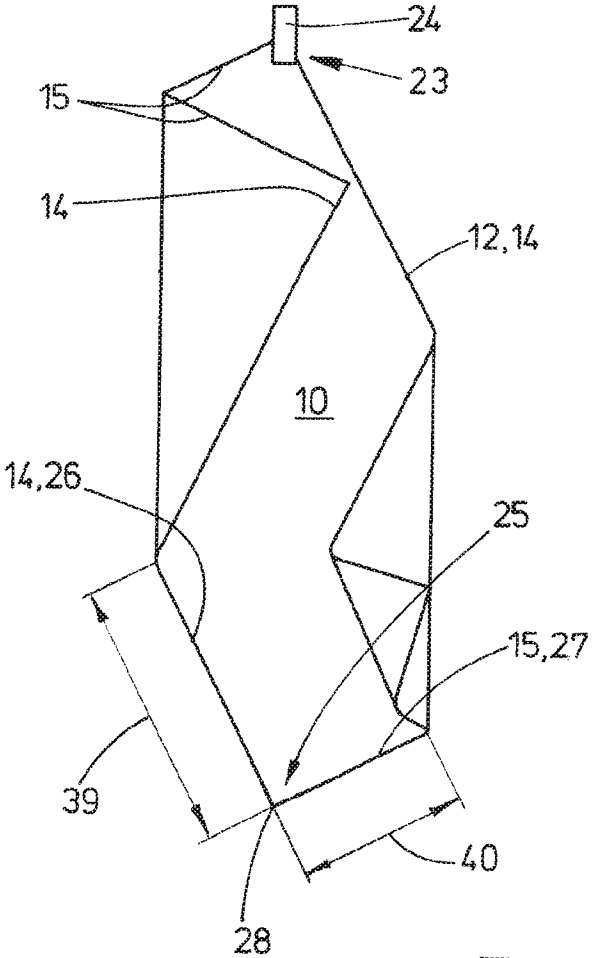
FIG. 5 is a third embodiment for measuring the lower part of the item of laundry in a depiction analogous to FIGS. 3 and 4.

The automatic determination of long edge 14 and short edge 15 of item of laundry 10 may be carried out according to the method according to the invention in different ways, which are principally depicted in FIGS. 3 to 5.

The image analysis determines the angles of edge areas 26 and 27, extending from second corner 25, in particular from its corner points 28, from the image recorded by camera 29, in particular the image data, of the lower part of item of laundry 10 with second corner 25 and edge areas 26 and 27. For rectangular items of laundry 10, these angles are different. If the angles are equal or approximately equal, then it is a square item of laundry, for which no further analysis is necessary, because there is no long edge 14 and no short edge 15, instead, all four edges are equally long.

In the case depicted in FIG. 3 of rectangular item of laundry 10, for which the invention is preferably designed, the angles are determined in relation to an imaginary horizontal reference line 35 through corner point 28 of second corner 25. There is thereby an angle 36A between horizontal reference line 35 and edge area 26 and an angle 37A between horizontal reference line 35 and edge area 27. When measuring angles 36A and 37A relative to horizontal reference line 35, larger angle 36A belongs to longer edge 14 and smaller angle 37A belongs to shorter edge 15.

After the electronic image analysis has determined angles 36A and 37A from the image recorded by camera 29 of a lower part of item of laundry 10, a comparison of angles 36A and 37A is carried out. From this, it is then automatically derived by calculations which edge area 26 or 27 belongs to long edge 14 or to short edge 15. This derivation is carried out based on the knowledge that, for rectangular item of laundry 10 hanging freely from first corner 23, longer edge 14 extends through corner point 28 of lower second corner 25 at a larger angle to horizontal reference line 35 than shorter edge 15. Consequently, in the present case, it may be derived from larger angle 36A between edge area 26 and reference line 35 that edge area 26 belongs to long edge 14 of item of laundry 10 and edge area 27 belongs to a shorter edge 15 of item of laundry 10.

The method for determining longer edge 14 and shorter edge 15 of item of laundry 10 is carried out in the embodiment from FIG. 4 principally exactly as previously described. However, angle 36B of edge area 26 and angle 37B of edge area 27 are determined with respect to a vertical reference line 38 through corner point 28 of second corner 25. Consequently, angle 36B is located between vertical reference line 38 and edge area 26 and angle 37B is located between vertical reference line 38 and edge area 27. When using vertical reference line 38, smaller angle 36B is the one that belongs to edge area 26 of long edge 14. In contrast, edge area 27, which extends at larger angle 37B to vertical reference line 38, belongs to shorter edge 15 of item of laundry 10.

FIG. 5 illustrates the automatic determination of long edge 14 and/or shorter edge 15 by analyzing an image recorded by camera 29 of lower partial surface of item of laundry 10. A comparison of the lengths of edge areas 26 and 27 is thereby carried out. In this type of determination of long edge 14 and/or short edge 15 of item of laundry 10, it is based on the knowledge that, in the case of a rectangular item of laundry 10 hanging freely from upper first corner 23 with two parallel long edges 14 and two parallel short edges 15, edge areas 26 and 27, extending from corner point 28 of lower second corner 25 and extending in a straight line or at least approximately in a straight line, are different lengths. Furthermore, it has been shown that straight edge area 26 of longer edge 14 has a greater length 39 than the length of edge area 27 of short edge 15. If, accordingly, the image analysis device automatically determines lengths 39 and 40 of edge sections 26 and 27 from the image data of the lower part of the item of laundry recorded by camera 29, and has compared lengths 39 and 40, then longer edge area 26 belongs to long edge 14 and shorter edge area 27 belongs to short edge 15 of item of laundry 10. Correspondingly long edge 14 is automatically derived from longer edge area 26 and shorter edge 15 is derived from shorter edge area 27.

Different modifications of the previously described methods are possible within the scope of the invention.

For example, in a deviation from the previously described embodiment, a short edge 15 of item of laundry 10, determined according to the previously described method, may also form front edge 12 of item of laundry 10 extending transverse to feed direction 13. Then, adjacent parallel clips 30 grip edge area 26 belonging to long edge 14 close to second corner 25 or at corner point 28 of the same and at a distance from corner point 28 for freely hanging short edge 15 straight down extending from corner point 28 of second corner 25.

It is also conceivable that item of laundry 10 is not deposited—as initially described—with long edge 14, or also short edge 15, aligned straight and facing away from inserting machine 11 on depositing area 34 at the beginning of cascade conveyor 31, but instead is deposited with long edge 14 or short edge 15 aligned straight and facing toward inserting machine 11. Then item of laundry 10 is deposited facing the other way in a U-shape across depositing area 34 of cascade conveyor 31, as is depicted in FIG. 7.

The invention is also suited for alternative automated feeding of items of laundry 10 with a desired long edge 14 or short edge 15 as a front edge 12 extending in feed direction 13 to an inserting machine 11 designed differently or to another laundry treatment apparatus. For example, after the determination of desired long edge 14 or short edge 15 with long edge 14 and short edge 15 as front edge 12, item of laundry 10 may also be inserted with adjacent corners of front edge 12 in loading clips of inserting machine 11 or directly into spreading clips of inserting machine 11 instead of into loading conveyor 32.

In all variants of the invention, in particular in the previously described variants, a completely automated feeding is carried out of items of laundry 10 to a laundry treatment machine, for example, also to a sorting device or sorting assembly, after a preferably previous automatic determination of long edge 14 and/or of short edge 15, in particular of rectangular items of laundry, namely items of laundry 10 with different lengths of edges 14, 15.

LIST OF REFERENCE NUMERALS

10 Item of laundry
11 Inserting machine
12 Front edge
13 Feed direction
14 Long edge
15 Short edge
16 Separator
17 Edge detection device
18 Spreading out device
19 Pile of laundry
20 Camera
21 Gripper
22 Preparation device
23 First corner
24 Holding means
25 Second corner
26 Edge area
27 Edge area
28 Corner point
29 Camera
30 Clip
31 Cascade conveyor
32 Loading conveyor
33 Belt conveyor
34 Depositing area
35 Horizontal reference line
36A Angle (larger angle relative to horizontal reference line 35)
36B Angle (smaller angle relative to vertical reference line 38)
37A Angle (smaller angle relative to horizontal reference line 35)
37B Angle (larger angle relative to vertical reference line 38)
38 Vertical reference line
39 Length
40 Length
41 Stabilizing bar

What is claimed is:

1. A method for determining a longer edge (14) and/or a shorter edge (15) of an item of laundry (10) having a first corner (23), a second corner (25), and respective edge areas (26, 27) extending from the second corner (25), the method for use in feeding the item of laundry (10) to a laundry treatment apparatus, the method comprising:

a) hanging the item of laundry (10) in a manner whereby the second corner (25) extends freely downward and the respective edge areas (26, 27) extend from the second corner (25);

b) recording images of the respective edge areas (26, 27) or respective lengths (39, 40) of the respective edge areas (26, 27) by at least one image-providing device;

c) determining the respective lengths (39, 40) of the respective edge areas (26, 27) extending from the second corner (25) by image analysis;

d) determining that a longer of the respective edge areas (26) belongs to the longer edge (14) and that a shorter of the respective edge areas (27) belongs to the shorter edge (15) of the item of laundry (10); and e) supplying the item of laundry (10) to the laundry treatment apparatus in a targeted way for further treatment of the item of laundry (10), with one of the longer edge (14) or the shorter edge (15) extending transversely to a feed direction (13) to the laundry treatment apparatus.

2. The method as claimed in claim 1, wherein the edge areas (26, 27) of the item of laundry (10) extend from a corner point (28) of the second corner (25).

3. The method as claimed in claim 1, wherein the longer edge (14) and/or the shorter edge (15) of the item of laundry (10) is determined from a comparison of the measurements of the respective lengths (39, 40) of the respective edge areas (26, 27) extending from the second corner (25).

4. The method as claimed in claim 1, further comprising analyzing the images and measuring the respective lengths (39, 40) of the respective edge areas (26, 27) extending from a corner point (28) of the second corner (25).

5. The method as claimed in claim 1, wherein the second corner (25) is diagonally opposite the first corner (23) and wherein the item of laundry (10) is hanging freely down from the first corner (23).

6. A method for determining a longer edge (14) and/or a shorter edge (15) of an item of laundry (10) having a first corner (23), a second corner (25), and respective edge areas (26, 27) extending from the second corner (25), the method for use in feeding the item of laundry (10) to a laundry treatment apparatus, the method comprising:

a) hanging the item of laundry (10) in a manner whereby the second corner (25) extends freely downward and the respective edge areas (26, 27) extend from the second corner (25);

b) recording images of the respective edge areas (26, 27) by at least one image-providing device;

c) analyzing the images and comparison of the respective angles (36A, 37A; 36B, 37B) of between the respective edge areas (26, 27) extending from the second corner (25) relative to at least one imaginary vertical reference line (38) or horizontal reference line (35) through a corner point (28) of the second corner (25);

d) determining the longer edge (14) of the item of laundry (10) and/or the shorter edge (15) of the item of laundry (10) by image analysis of the respective angles (36A, 37A; 36B, 37B) between the respective edge areas (26, 27) extending from the second corner (25), wherein relative to a vertical reference line (38) the longer edge (14) is a respective one of the edge areas (26) that extends at a smaller angle (36B) of the respective angles (36B, 37B) and the shorter edge (15) is a respective one of the edge areas (27) that extends at a larger angle (37B) to of the respective angles (36B, 37B), or relative to a horizontal reference line (35) the longer edge (14) is a respective one of the edge areas (26) that extends at a larger angle (36A) of the respective angles (36A, 37A) and the shorter edge (15) is a respective one of the edge areas (27) that extends at a smaller angle (37A) to of the respective angles (36A, 37A); and e) supplying the item of laundry (10) to the laundry treatment apparatus in a targeted way for further treatment of the item of laundry (10), with one of the longer edge (14) or the shorter edge (15) extending transversely to a feed direction (13) to the laundry treatment apparatus.

7. The method as claimed in claim 6, wherein the second corner (25) is diagonally opposite the first corner (23) and wherein the item of laundry (10) is hanging freely down from the first corner (23).

8. The method as claimed in claim 6, wherein the respective angles (36A, 37A; 36B, 37B), which are considered for determining the longer edge (14) and/or the shorter edge (15) of the item of laundry (10), lie between one of the respective edge areas (26, 27) and the imaginary horizontal reference line (35).

9. The method as claimed in claim 6, wherein the edge areas (26, 27) of the item of laundry (10) extend from a corner point (28) of the second corner (25).

* * * * *